United States Patent [19]

Castiglioni

[11] 4,441,346

[45] Apr. 10, 1984

[54] COMBINATION LOCK WITH A SINGLE KNOB BOTH FOR CONTROLLING THE OPENING AND FOR CHANGING THE LOCK COMBINATION

[75] Inventor: Claudio Castiglioni, Varese, Italy

[73] Assignee: C.G.V. S.a.S. di Claudio Castiglioni & C., Italy

[21] Appl. No.: 175,903

[22] Filed: Aug. 6, 1980

[30] Foreign Application Priority Data

Sep. 7, 1979 [IT] Italy ..... 22488/79[U]

[51] Int. Cl.[3] ..... E05B 37/02

[52] U.S. Cl. ..... 70/312; 70/316

[58] Field of Search ..... 70/67–76, 70/311–312, 315–318

[56] References Cited

U.S. PATENT DOCUMENTS

| | | | |
|---|---|---|---|
| 2,163,852 | 6/1939 | Pond | 70/317 |
| 3,543,545 | 12/1970 | Budzyn | 70/312 |
| 3,720,082 | 3/1973 | Feinberg | 70/318 |
| 3,766,758 | 10/1973 | Heine | 70/318 |
| 4,048,821 | 9/1977 | Bako | 70/316 |
| 4,123,923 | 11/1978 | Bako | 70/316 |
| 4,155,234 | 5/1979 | Bako | 70/312 |

*Primary Examiner*—Robert L. Wolfe

*Attorney, Agent, or Firm*—Steinberg & Raskin

[57] ABSTRACT

The combination lock comprises a shaft (12) to which a cross-member 15 is fixed at the opposite end to that comprising the bolt (9).

Between the cross-member (15) and the end of a bush (21) closest to it there is disposed an appendix (40) associated with the knob (42), by means of which, when the knob (42) is moved in one direction and the predetermined combination is set, the shaft (12) and thus the bolt (9) are moved axially, whereas when the knob is moved in the opposite direction, the bushes (21, 22, 23, 24) are moved and are thus disengaged from the combination discs (29), making it therefore possible to change the combination (FIG. 1).

3 Claims, 4 Drawing Figures

COMBINATION LOCK WITH A SINGLE KNOB BOTH FOR CONTROLLING THE OPENING AND FOR CHANGING THE LOCK COMBINATION

DESCRIPTION

This invention relates to a combination lock of the type comprising an engagement member designed for fixing to one of the two parts of a container, such as a bag, case or the like, and a combination device fixed to the other part of the container and provided with a bolt arranged to cooperate with said engagement member.

The combination device comprises:

(a) a set of rotatable but axially fixed combination discs;

(b) a set of bushes torsionally engageable with said discs in order to rotate with them and provided with inner axial grooves, and mounted on an axially movable but not rotatable shaft which carries the bolt and which comprises radial projections which, when aligned with said inner grooves, enables the shaft and bolt to be moved when the user moves a control knob.

In known locks of this type, in order to change the combination, a lever is provided on the inside of that part of the container on which the device is mounted, so that when this lever is moved in one direction after the original combination (which it is required to change) has been set, the bushes are disengaged from the combination discs against the action of a spring, and these discs can then be rotated relative to the bushes which do not participate in the rotation in that their grooves cover the shaft projections. When the discs have been moved manually into the position corresponding to the new combination, the bushes re-engage with the combination discs under the action of the spring when the lever is returned to its initial position.

In this known method, in order to vary the combination it is therefore necessary to open the container (bag, case or the like), which is certainly uncomfortable. Consequently, the basic object of the present invention is to provide means of particularly simple construction which enable the numerical combination to be easily and quickly varied, i.e. said shaft to be moved axially, by an operation which can be carried out manually by acting from the outside of the container (case, bag or the like) on the knob used for controlling opening, without having to open the container itself.

According to the invention a cross-member is fixed to the opposite end of the shaft to that comprising the bolt, and between said cross-member and the end of the bush closest to said cross-member there is inserted an appendix associated with the knob, by means of which, when the knob is moved in one direction and the predetermined combination is set, the shaft and thus the bolt are moved axially, whereas when the knob is moved in the opposite direction, the bushes are moved axially and are thus disengaged from the combination discs.

The invention will be more apparent from the detailed description given hereinafter by way of example with reference to the accompanying drawing, in which.

Figure 1:
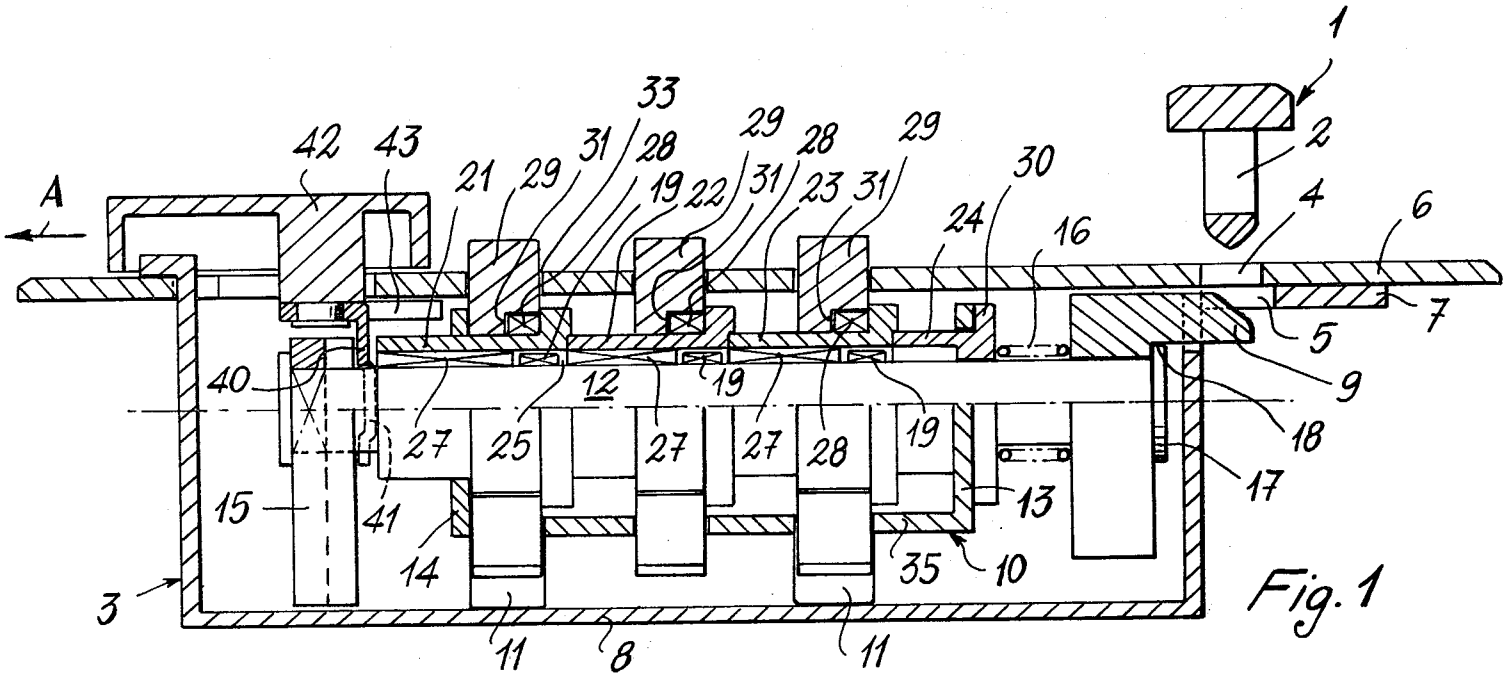
FIG. 1 is a partly sectional view of the lock according to the invention.
Figure 4:
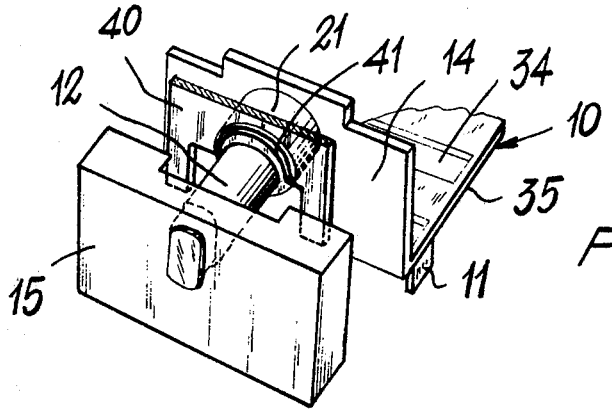
FIG. 4 is a perspective view of the cross-member fixed to one end of the shaft, the appendix fixed to the knob, and the end bush.
Figure 3:
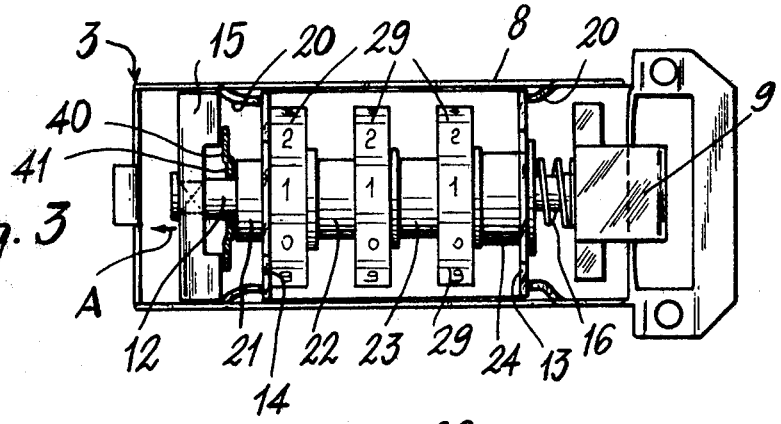
FIG. 3 is a plan view of the lock with the cover removed, to a reduced scale.

With reference to the figures, the lock comprises an engagement member 1 provided with a bore 2. Said member 1 is connected in any known manner to one part of the container such as a bag, case or the like, to which the lock is fitted. The lock also comprises a combination device, indicated overall by 3, and fixed in any known manner to the other part of the container.

The container becomes closed when the engagement member 1 is inserted through facing apertures 4, 5 (present in the cover 6 and in a flange 7 on the casing 8 of the combination device), and the bolt 9 of said device is inserted into the bore 2.

Inside the casing 8 there is disposed a U support indicated by 10, which is supported on the base of said casing by feet 11, and is prevented from moving laterally by four bent tabs 20 provided in the side walls of the casing 8.

The cover 6 is fixed to the casing 8 in any known manner.

A shaft 12 extends through the support 10, and projects beyond the walls 13, 14 of this latter. A cross-member 15 of substantially rectangular shape is rigid with one end of the shaft 12, and prevents the shaft from rotating about its longitudinal axis by cooperating with the walls of the casing 8, which are disposed at a right angle to each other. The cross-member 15 and shaft 12 can however be moved in the direction of the arrow A, as will be apparent hereinafter, when the predetermined combination has been set. The movement of the cross-member 15 in the opposite direction is opposed by the tabs 20.

The bolt 9, of L cross-section, is slidably mounted at the other end of the shaft 12, and is urged by a compression spring 16 disposed between a flange 30 of a bush 24 and said bolt, against a flange 17 with its upper face 18 flattened and present at said end of the shaft 12.

With this arrangement, even when the predetermined combination has not been set, it is still possible to close the container (bag, case etc.) because on inserting the engagement member 1 into the bores 4, 5, the bolt 9 firstly recedes against the spring, then snaps into the bore 2 in said engagement member.

The shaft 12 comprises a set of radial aligned prongs 19 (there are three prongs in this example).

Bushes 21, 22, 23 and 24 are mounted on the shaft 12. As stated, the spring 16 acts on the flange 30 of the bush 24, and this flange adheres against the wall 13, whereas the rest of the bush traverses a bore in said wall. The bushes 21, 22, 23 comprise an internal bore formed from two portions, namely a larger portion 25 (the radius of which is greater than the sum of the radius of the shaft 12 and the radial extension of the prong 19), and a smaller portion 26 (substantially equal to the diameter of the shaft 12) in which an axial groove 27 is present into which the prong 19 can penetrate when all the prongs are aligned with said grooves.

Figure 2:
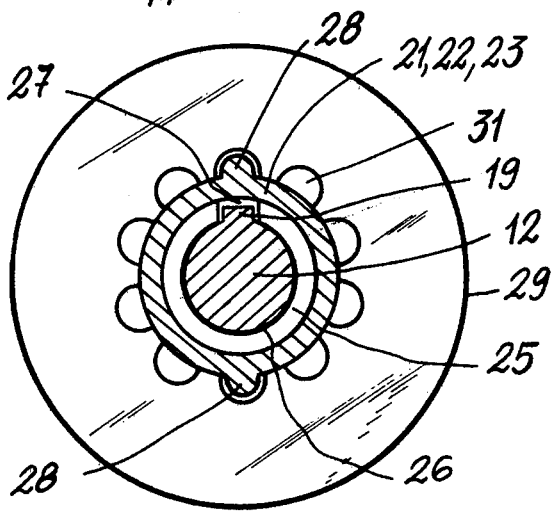
FIG. 2 is a section through a detail taken in a plane perpendicular to the geometrical axis of the shaft forming part of the lock.

Furthermore, each bush 21, 22, 23 comprises at least one outer projection 28 (FIG. 2 shows two diametrically opposing projections).

At each of the bushes 21, 22 and 23, there is provided an operating wheel or combination disc 29 carrying a series of figures, letters or other signs on its periphery for forming the combination. Each disc 29 comprises a central bore through which the relative bush extends. Each disc 29 also comprises on one face a set of cavities 31 arranged to receive the projections 28 of the corresponding bush in order to torsionally couple each disc to its bush so that when the disc rotates, the bush also rotates. The number of cavities 31 is equal to the number of figures or the like provided on the combination disc.

The combination discs 29 are guided in slots 33, 34 present in the cover 6 and the base of the support 10 respectively, so that they cannot move axially.

The bush 21 projects beyond the wall 14 of the support 10, and into the space between the end of said bush and the cross-member 15 there extends a fork element 40 with a rounded or semi-circular central part 41 having a diameter less than the diameter of the end of the bush 21. Said fork element 40 is rigidly connected in any known manner to the knob 42, and comprises a pair of parallel guide appendices 43.

When the predetermined combination has been set by rotating the combination discs 29, the grooves 27 of the bushes become aligned with the prongs 19 present on the shaft 12. If the knob 42 is then moved in the direction of the arrow A, its fork 40 moves the cross-member 15 and the shaft 12 rigid therewith in the same direction, so that the bolt 9 also moves in the same direction to withdraw from the bore 2, and consequently the engagement member 1 withdraws from the bores 4 and 5, and the container to which the lock is fitted can be opened. If the knob 42 is moved in the opposite direction to the arrow A, the shaft 12 does not move axially because the cross-member 15 rests against the stops 20, but instead all the bushes 21, 22, 23 and 24 move axially together against the spring 16. During this movement, the projections 19 on the shaft 12 become inserted into the grooves 27 of the bushes 21, 22, 23, so that said bushes cannot rotate. In addition, the projections 28 on the bushes 21, 22, 23 become disengaged from the cavities 31 of the combination discs 29, which can then be rotated independently in order to set a new combination, after which the knob 42 is released and the spring 16 pushes the bushes backwards so causing the projections 28 on the bushes to engage in the new chosen cavities 31 in the combination discs 29, so that the torsional coupling between the bushes and discs becomes re-established.

What we claim is:

1. A combination lock with an axially movable but non-rotatable shaft which carries a bolt and comprises radial projections, on said shaft there being mounted combination discs and bushes which can be coupled with said discs in order to rotate with them, and are provided with inner axial grooves which, when aligned with the radial projections on the shaft, enable the shaft and bolt to be moved when the user moves a control knob, wherein a cross-member (15) is fixed to that end of the shaft (12) opposite the end comprising the bolt (9), and between said cross-member (15) and the end of the bush (21) closest to it there is disposed an appendix (40) associated with the knob (42), by means of which, when the knob (42) is moved in one direction and the predetermined combination is set, the shaft (12) and thus the bolt (9) are moved axially, whereas when the knob is moved in the opposite direction, the bushes (21, 22, 23, 24) are moved and are thus disengaged from the combination discs (29), making it therefore possible to change the combination.

2. A lock as claimed in claim 1, wherein the appendix (40) is of fork configuration, with arms which act on the cross-member (15) and with a central rounded zone (41) which act on the end bush (21).

3. In a combination lock having setting discs which are arranged alongside of each other on a shaft, are turnable independently of each other and extend through slots in a front plate of a lock case, having a plurality of aligned locking sleeves associated with the setting discs, seated on the shaft and in spring-biased coupling engagement with the setting discs and formed with depressions which, when the combination number is correctly set, and located in a position opposite projections, and having an actuating handle arranged on the front plate, which handle can be displaced longitudinally from a basic position thereof in a direction toward an opening position of the lock in order to release a hasp which extends into inside of the lock case through an opening in the front plate and cooperates with a latch member, the actuating handle also for operatively displacing the locking sleeves out of their position of coupling engagement with the setting discs, the improvement comprising: said actuating handle is mounted displaceably from said basic position thereof in a displacement movement in a direction opposite the direction toward said opening position of the lock and constitutes means during said displacement movement for pushing the locking sleeves out of said position of coupling engagement.

* * * * *